US009101944B2

(12) United States Patent
Manzella et al.

(10) Patent No.: US 9,101,944 B2
(45) Date of Patent: Aug. 11, 2015

(54) DRIVE SYSTEM FOR CENTRIFUGE

(71) Applicant: FENWAL INC., Lake Zurich, IL (US)

(72) Inventors: Salvatore J. Manzella, Barrington, IL (US); Gregory G. Pieper, Spring Grove, IL (US); Thimothy J. Getschman, Kenosha, WI (US)

(73) Assignee: Fenwal, Inc., Lake Zurich, IL (US)

( * ) Notice: Subject to any disclaimer, the term of this patent is extended or adjusted under 35 U.S.C. 154(b) by 91 days.

(21) Appl. No.: 14/113,231

(22) PCT Filed: Nov. 15, 2012

(86) PCT No.: PCT/US2012/065224

§ 371 (c)(1),
(2) Date: Oct. 22, 2013

(87) PCT Pub. No.: WO2013/103446

PCT Pub. Date: Jul. 11, 2013

(65) Prior Publication Data

US 2014/0066282 A1 Mar. 6, 2014

Related U.S. Application Data

(60) Provisional application No. 61/583,037, filed on Jan. 4, 2012.

(51) Int. Cl.
*B04B 9/08* (2006.01)
*B04B 5/04* (2006.01)

(52) U.S. Cl.
CPC ..... *B04B 9/08* (2013.01); *B04B 5/0442* (2013.01)

(58) Field of Classification Search
CPC ..... B04B 9/08; B04B 9/10; B04B 2007/005
USPC ..... 494/18, 84
See application file for complete search history.

(56) References Cited

U.S. PATENT DOCUMENTS 3,586,413 A * 6/1971 Adams ..... 359/503
3,986,442 A * 10/1976 Khoja et al. ..... 475/182

(Continued)

FOREIGN PATENT DOCUMENTS

WO WO 9312888 A1 * 7/1993 ..... B04B 7/08

OTHER PUBLICATIONS

International Preliminary Report on Patentability for PCT/US2012/065224, dated Mar. 11, 2013.

(Continued)

*Primary Examiner* — Charles Cooley
*Assistant Examiner* — Shuyi S Liu
(74) *Attorney, Agent, or Firm* — Cook Alex Ltd.

(57) ABSTRACT

A drive assembly for a centrifugal processing system is provided for rotating the yoke assembly (36) about a first axis at a first angular velocity and rotating the chamber assembly (30 coaxially with the yoke assembly at a second angular velocity A drive motor (54) is provided for rotating the yoke assembly at the first angular velocity and simultaneously rotating the chamber assembly at the second angular velocity by means of a stationary first gear (64), a second gear (68) mounted to the yoke assembly that operatively engages the first gear, a third gear (74) rotatably mounted to the yoke assembly so as to synchronously rotate with the second gear, and a fourth gear (76) fixed to the chamber assembly that operatively engages the third gear so as to rotate the chamber assembly (30) relative to the yoke assembly (36) upon rotation of the yoke assembly about the first gear.

8 Claims, 6 Drawing Sheets

(56) References Cited

U.S. PATENT DOCUMENTS

| | | | | |
|---|---|---|---|---|
| 4,108,353 | A * | 8/1978 | Brown | 494/18 |
| 4,228,009 | A * | 10/1980 | Ito | 210/198.2 |
| 4,419,089 | A | 12/1983 | Kolobow | |
| 6,582,349 | B1 * | 6/2003 | Cantu et al. | 494/1 |
| 6,709,377 | B1 | 3/2004 | Rochat | |
| 2002/0016243 | A1 * | 2/2002 | Carr | 494/37 |

OTHER PUBLICATIONS

Int'l Appln. No. PCT/US2012/065224, filed Nov. 15, 2012, Written Opinion of the IPEA, Oct. 8, 2013.

* cited by examiner

DRIVE SYSTEM FOR CENTRIFUGE

CROSS-REFERENCE TO RELATED APPLICATION

This application claims the benefit of U.S. patent application Ser. No. 61/583,037 filed Jan. 4, 2012, which is hereby incorporated herein by reference.

FIELD OF THE DISCLOSURE

The present disclosure relates to a centrifugal processing system, and more particularly to a drive system for a centrifuge for blood cell separation and collection.

BACKGROUND

Continuous blood cell separation and collection is a well-known process for collecting desired blood components, such as red blood cells, platelets or plasma, from a donor. Typically, whole blood is withdrawn from a donor and directed into a centrifugal processing chamber to separate the whole blood into its various components. This is often carried out utilizing blood processing systems and methods comprising a durable centrifuge in association with a single-use, sterile fluid circuit including a processing chamber and associated storage containers, fluid flow tubing, and the like. The processing chamber is usually mounted in a centrifuge rotor or bowl, which spins with the chamber, creating a centrifugal field that separates the whole blood into its components based on their density.

Well-known and exemplary centrifugal blood processing systems include the Amicus® and Alyx® separators, available from Fenwal, Inc. of Lake Zurich, Ill. Various functional aspects of the Amicus® separator are disclosed in, e.g., U.S. Pat. Nos. 6,312,607 and 6,582,349, the entire disclosures of which are incorporated herein by reference.

In a centrifugal processing system such as the Amicus® separator, a centrifuge chamber assembly is rotatably mounted to a yoke, and a drive is provided such that the yoke is rotated at a first angular velocity (known as the "one omega" or "1Ω" velocity) and the bowl rotates at a second angular velocity that is twice the first angular velocity (known as the "two omega" or "2Ω" velocity). This relationship of the centrifuge chamber having an angular velocity twice that of the yoke ensures that the conduit, or bundle of tubings, leading to and from the processing chamber that forms a part of the single-use fluid processing circuit, commonly called the "umbilicus", is not twisted by the rotation of the centrifuge.

In one example of a centrifugal processing system of the prior art, a first electric motor spins the yoke assembly at one omega, while a second electric motor mounted to the yoke spins the centrifuge chamber assembly at the same speed of rotation, in the same direction, and about the same axis as the first electric motor spins the yoke assembly. See U.S. Pat. No. 5,360,542, which is incorporated herein by reference. As a result, when viewed from a stationary or non-rotating position, the centrifuge chamber spins at twice the rotational speed of the yoke assembly, thus providing for the one omega-two omega relationship between the yoke and centrifuge chamber.

By way of the present disclosure, an improved drive system for a centrifuge system is provided that utilizes a single motor to rotate both the yoke and the centrifuge chamber assembly.

SUMMARY OF THE DISCLOSURE

The present subject matter has a number of aspects which may be used in various combinations and the disclosure herein of one or more specific embodiments is for the purposes of disclosure and description, and not limitation. This summary highlights only a few of the aspects of the subject matter, and additional aspects are disclosed in the accompanying drawings and the following detailed description.

By way of the present application, a drive assembly that may advantageously be used in a centrifugal processing system is provided that rotates a first structure (the yoke assembly) about a first axis and at a first angular velocity relative to a stationary support, and rotates a second structure (the chamber assembly) coaxially with the first structure at a second angular velocity. The drive assembly includes a drive motor for rotating the first structure at the first angular velocity and the second structure at the second angular velocity, the second structure being mounted to the first structure so as to be rotatable relative to the first structure about a common axis of rotation.

In keeping with a first aspect of the disclosure, a drive system for the chamber assembly is provided that utilizes the rotation of the yoke assembly as the input to the drive system for the chamber assembly, so that the rotation of the yoke assembly about its axis also serves to rotate the chamber assembly relative to the yoke assembly. More specifically, a first "gear" is provided that is rotatably fixed relative to the stationary support. A second "gear" is rotatably mounted to the first structure (the yoke assembly) so as to rotate with the first structure about the common axis of rotation and to axially rotate relative to the first structure. The second "gear" is operatively engaged, either directly or indirectly, by the first "gear" to rotate the second "gear" relative to the first structure upon rotation of the first structure by the drive motor. A third "gear" is also rotatably mounted to the first structure so as to rotate with the first structure about the common axis and to axially rotate relative to the first structure synchronously with, and at the same rate of rotation as, the second "gear". A fourth "gear" is fixed to the second structure (the chamber assembly) for rotation therewith about the common axis of rotation. The fourth "gear" is operatively engaged, either directly or indirectly, by the third "gear" to rotate the second structure relative to the first structure upon rotation of the first structure by the drive motor.

In another aspect of the disclosure, the second "gear" and the third "gear" are mounted to a common second shaft.

In a further aspect of the disclosure, a first belt may operatively engage the first "gear" to the second "gear" and a second belt may operatively engage the third "gear" to the fourth "gear". Further, first and second idler "gears" may be rotatably mounted to the first structure for engagement with one of the first and second belts to ensure that the second structure rotates in the same direction about the axis of rotation as the first structure.

In a further aspect of the disclosure, the first "gear" is preferably mounted to a first linkage or shaft that is fixed to the stationary support so as to prevent the linkage or shaft and first "gear" from rotating about its axis.

In a further aspect of the disclosure, the ratios of the gears are such that for each revolution of the first structure about the first "gear" (i.e., for each revolution of the yoke) the second structure (i.e., the chamber assembly) rotates two revolutions in the same direction.

In keeping with another aspect of the disclosure, the yoke may comprise a pivoting arm to permit movement of the chamber assembly between a closed or operating position and an open position that facilitates access to the chamber assembly for attachment and removal of the single-use processing chamber.

DETAILED DESCRIPTION

A more detailed description of the drive system for a centrifugal processing system in accordance with the present disclosure is set forth below. It should be understood that the description below of a specific device is intended to be exemplary, and not exhaustive of all possible variations or applications. Thus, the scope of the disclosure is not intended to be limiting, and should be understood to encompass variations or embodiments that would occur to persons of ordinary skill.

Figure 1:
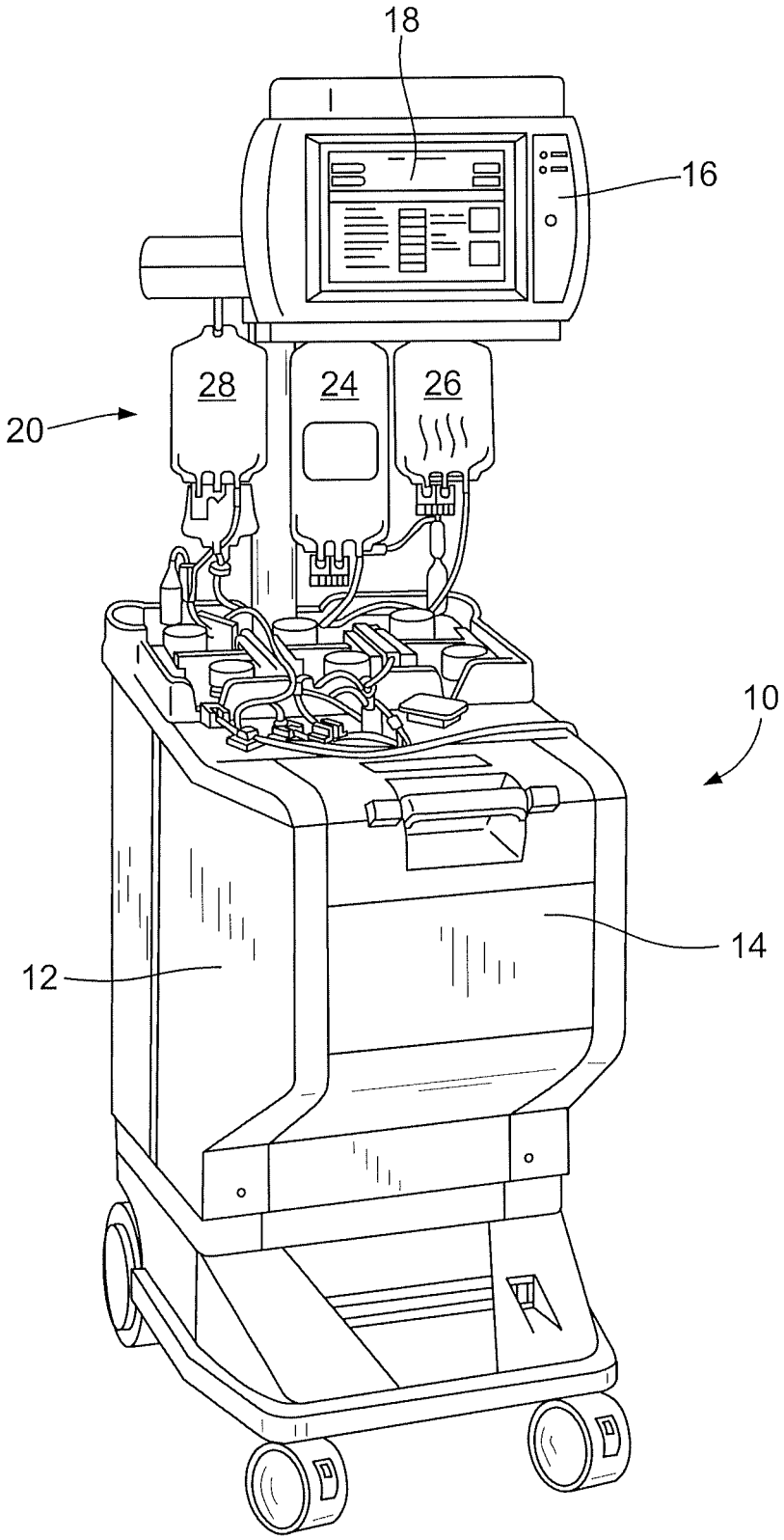
FIG. 1 is a perspective view of a centrifugal blood collection system that may utilize the drive system disclosed herein.

Turning to the drawings, there is seen in FIG. 1 a perspective view of a centrifugal blood separation system, generally designated 10, that may advantageously utilize the drive system of the present disclosure. The centrifuge system includes housing 12 for the centrifuge including a compartment 14 within which the centrifuge is mounted and which is slidable relative to the housing to provide access to the centrifuge. A micro-processor based controller or control system 16 is supported above the housing that includes a user interface in the form of a touch screen 18, through which data can be input and operation of the centrifuge system is controlled.

A single-use/disposable collection kit 20 is preferably used in combination with the system. The collection kit is typically made of a flexible plastic material, and includes, among other components, a processing container or chamber (not shown) that is mounted to the centrifuge chamber, as described in greater detail below. A tubing bundle, or umbilicus, 22 (best seen in FIGS. 2 and 3) connects the processing chamber to the donor, for withdrawing whole blood from the donor for introduction into the processing chamber and returning selected blood components to the donor. Additional tubings connect prefilled solution bags for saline (bag 24) and anticoagulant (bag 26) that are suspended above the centrifuge housing, as well as a collection bag 28 for receiving the blood component that has been separated in the centrifuge from the whole blood.

Figure 2:
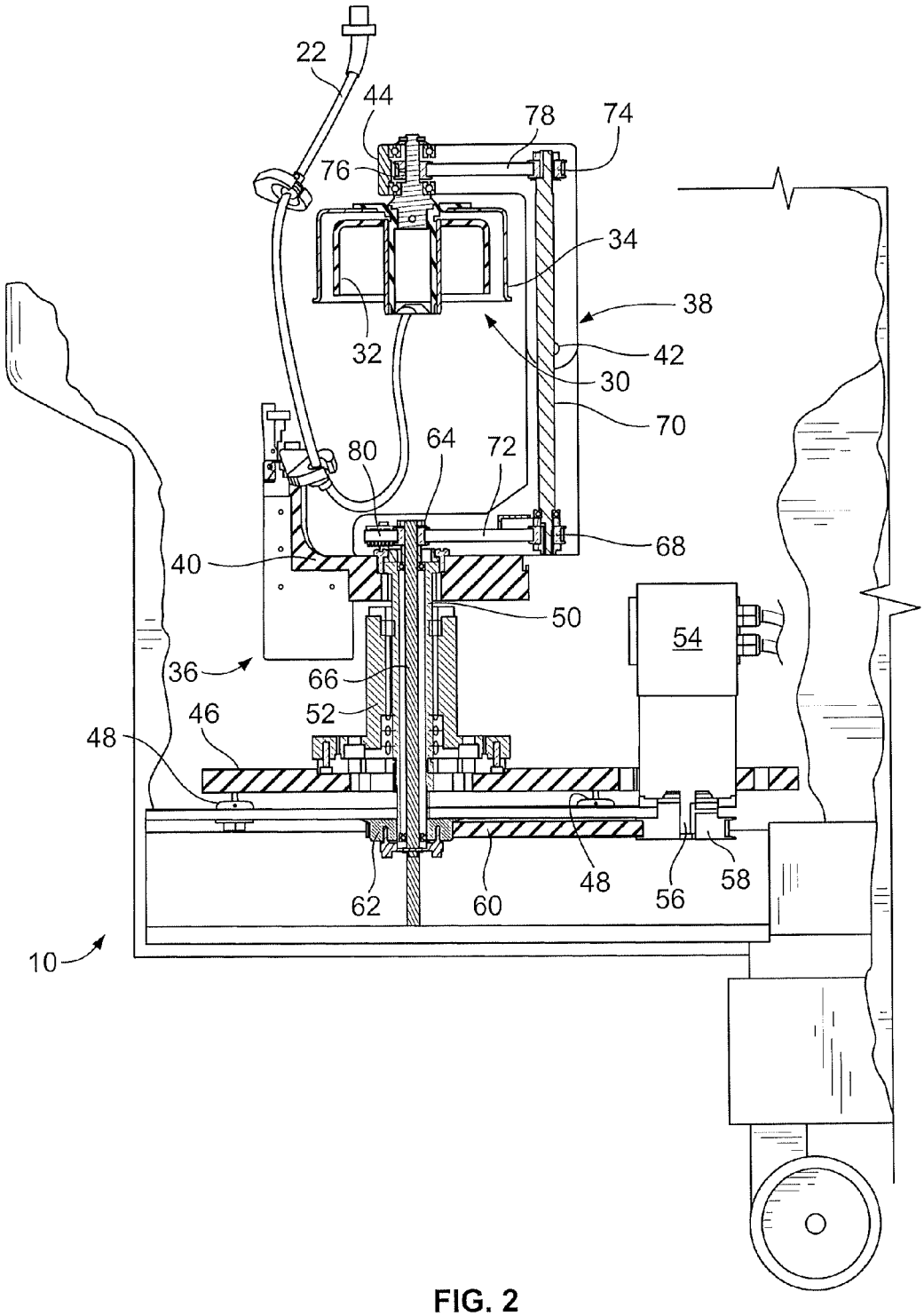
FIG. 2 is a fragmentary side elevational view of the centrifuge system of FIG. 1, with portions broken away to show the details of a preferred embodiment of the separation chamber and its drive system, with the yoke in its closed or operating position.
Figure 3:
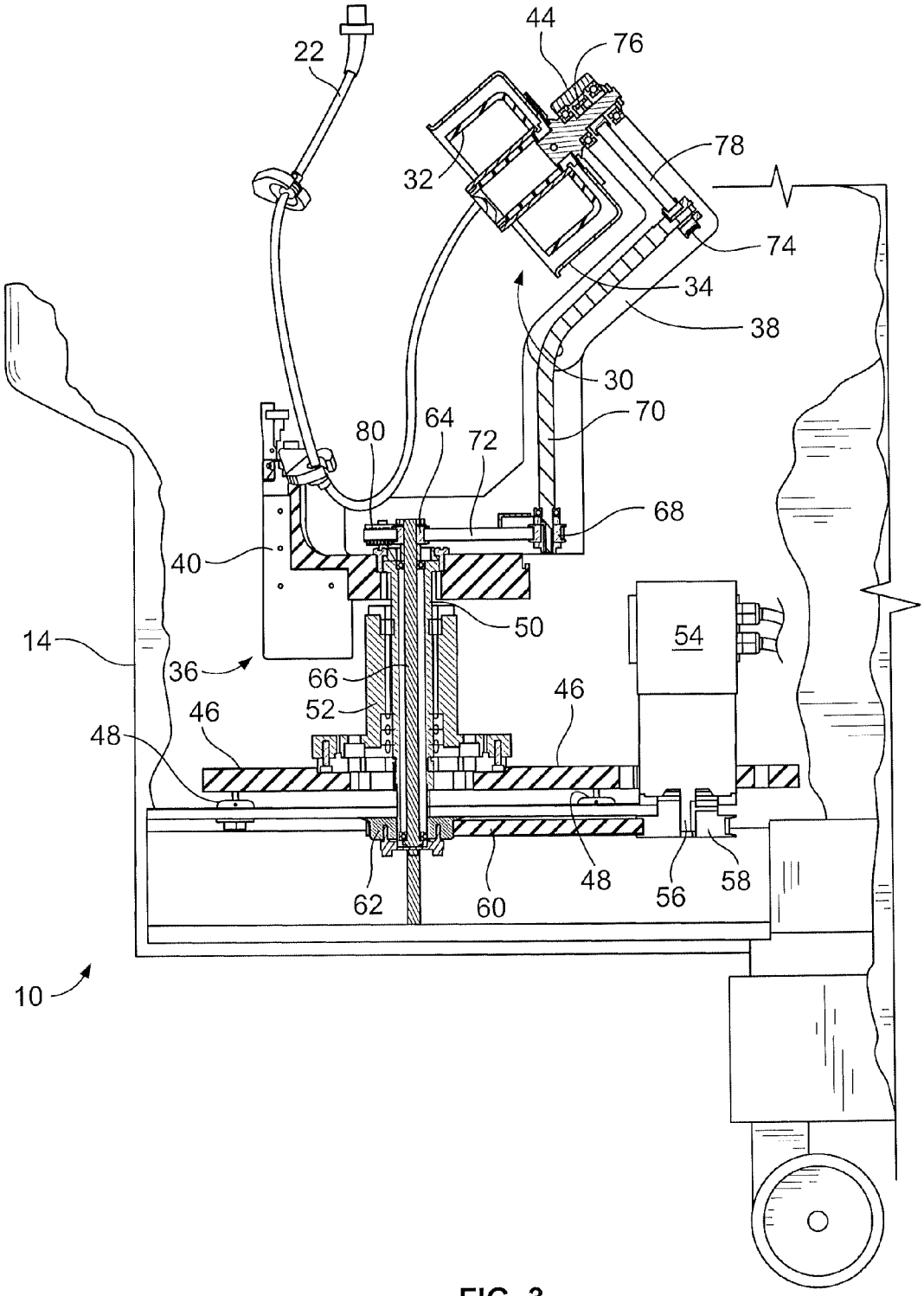
FIG. 3 is a side-elevational view similar to FIG. 2, with the yoke in its open position for facilitating attachment and removal of a single-use processing chamber to the chamber assembly.
Figure 4:
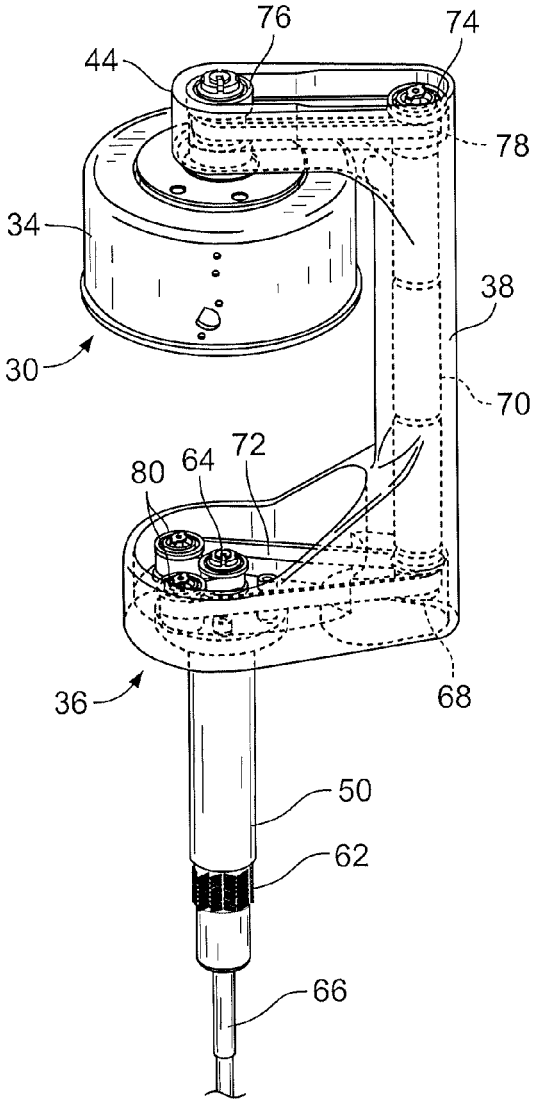
FIG. 4 is a perspective view of the yoke and chamber assembly enlarged to show detail.
Figure 5:
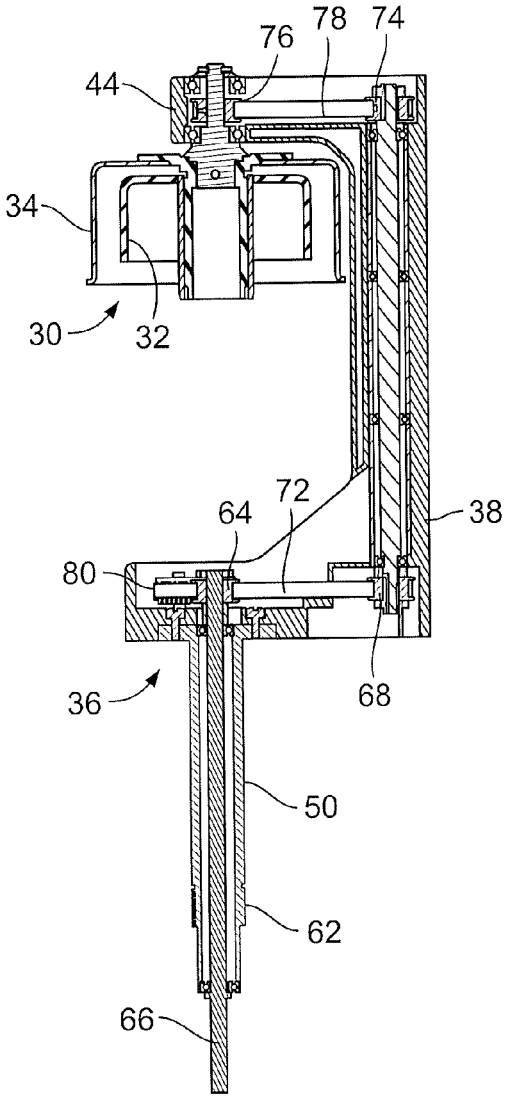
FIG. 5 is a cross-sectional view of the yoke and chamber assembly of FIG. 4.

Turning to FIGS. 2 and 3, the centrifuge system 10 includes a centrifuge chamber assembly, generally designated 30, comprising a spool 32 to which the processing chamber is mounted. The spool 32 is removably inserted into a bowl element 34 with the processing chamber wrapped about the spool. In operation, the spool 32 and bowl 34 are rotated in unison about a common axis. More specifically, the chamber assembly is mounted to a yoke assembly or frame, generally designated 36, so as to be movable between a first, open position (FIG. 3) to facilitate attachment and removal of the spool/processing chamber to the bowl 34, and a second, generally inverted closed position (FIG. 2), in which the processing chamber is enclosed between the spool 32 and the bowl 34 for operation of the centrifuge system.

Figure 7:
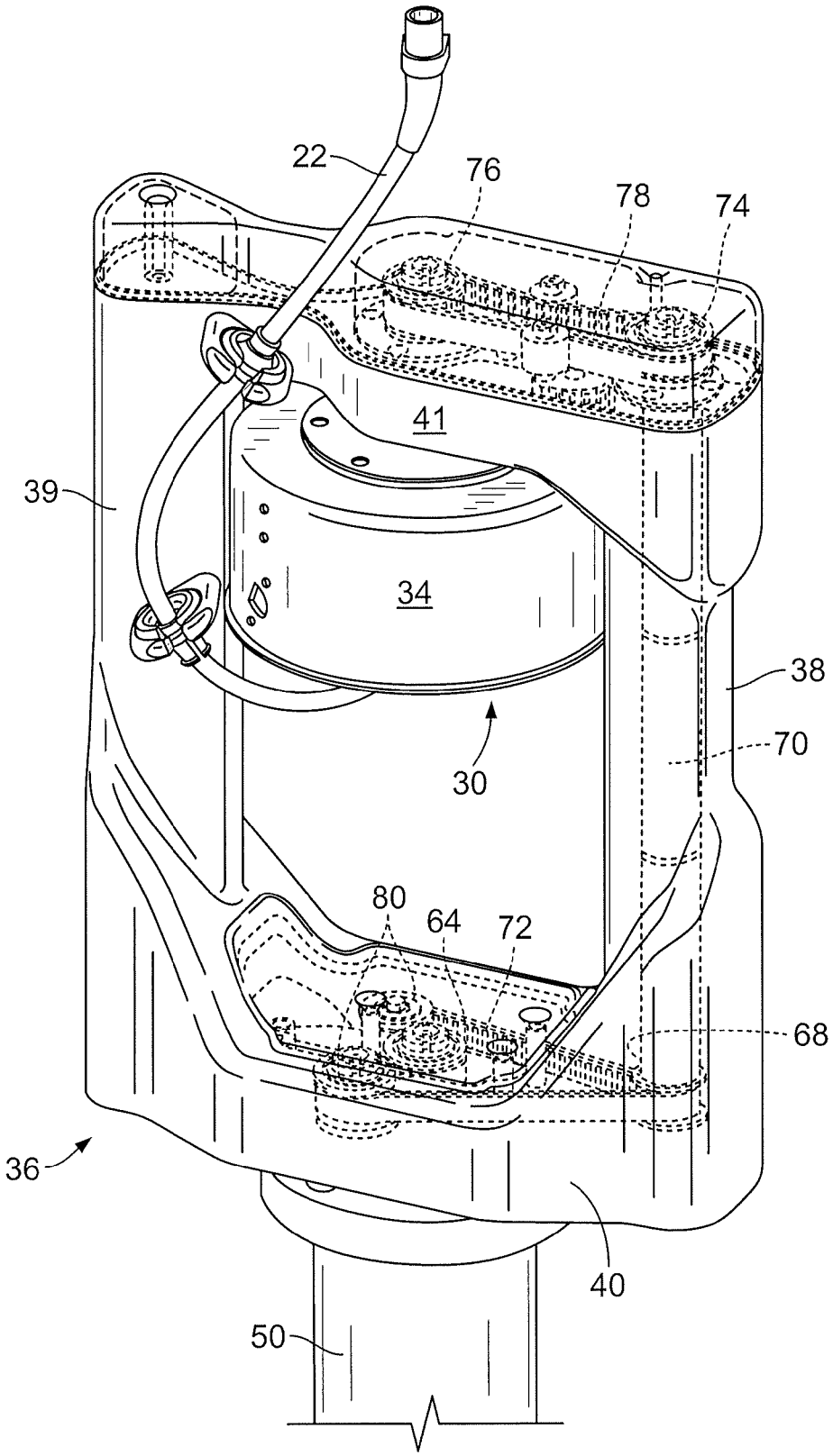
FIG. 7 is an enlarged perspective view of the yoke and chamber assembly having an alternative embodiment for the yoke.

In the illustrated embodiment, the yoke assembly includes an arm 38, generally in the shape of a "C", to which the chamber assembly 30 is rotatably mounted. The C-shaped arm 38 preferably is secured to a base member 40 that is mounted to the yoke assembly drive system, which is described in greater detail below. The C-shaped arm 38 of the yoke assembly 36 is adapted to permit movement of the chamber assembly 30 between an open position (as seen in FIG. 3) to permit access to the processing chamber, and a closed, operating position (as seen in FIG. 2). To this end, the arm 38, as illustrated, comprises at least two segments joined together by a hinge pin 42 that permits the pivoting of the free end 44 of the arm 38, although other configurations that permit the desired pivoting of the arm 38 may be employed. Preferably, and with reference to FIG. 7, the yoke assembly 36 comprises a unitary, rigid structure with arms 38 and 39 extending upwardly from the base 40, and the centrifuge chamber assembly 30 being supported from a cross bar 41 that interconnects the upper ends of the two arms 38 and 39.

In keeping with one aspect of the present disclosure, a drive assembly is provided for rotating a first structure (i.e., the yoke assembly) about its axis at a first angular velocity and simultaneously rotating a second structure (i.e., the centrifuge chamber assembly) coaxially with the first structure at a second angular velocity.

To rotate the yoke assembly 36 at the first angular velocity (at one omega), the yoke assembly 36 is rotatably secured to a mounting plate 46 that is secured within the cabinet 14 of the centrifuge on vibration absorbing mounts 48. More specifically, the yoke assembly 36 is preferably secured to a drive shaft 50 that is rotatably supported in a journal box/platform 52 that is secured to the mounting plate 46. A drive motor 54 is also preferably secured to the mounting plate 46. As illustrated, the drive motor 54 has a drive shaft 56 with a pulley 58 associated therewith that is connected by a belt 60 to a pulley 62 secured to the drive shaft 50 for the yoke assembly 36 to impart the one omega angular velocity to the yoke assembly 36. Other means for rotating the yoke assembly drive shaft 50 may be provided, such as a direct drive between the yoke assembly drive shaft and the drive motor drive shaft, intermeshing gears, etc.

In keeping with the disclosure, a drive system for the chamber assembly is provided that utilizes the rotation of the yoke assembly as the input to the drive system for the chamber assembly, so that the rotation of the yoke assembly about its axis also serves to rotate the chamber assembly relative to the yoke assembly.

To this end, and with reference again to the drawings, a first gear 64 is provided that is fixedly secured to the centrifuge 10 so as to be rotatably fixed or stationary relative to the yoke assembly 36. Note that while the term "gear" is being used to describe certain elements of the centrifuge drive system, it is not intended to limit the understanding of a "gear" to a toothed wheel structure, or the like. Instead, the term "gear" is intended to broadly cover all structures that would occur to a person skilled in the art that operatively connect a drive structure and a driven structure to one another to impart rotation from one to the other. As such, "gear" is intended to cover structures with intermeshing teeth, pulleys and wheels (either toothed or smooth), in combination with belts, chains, as well as other arrangements that would occur to a person skilled in the art.

Returning to the drawings, the first gear 64 is mounted to a stationary shaft 66 that is, in turn, secured to the housing 12 of the centrifuge 10. As illustrated, the first gear 64 is located coaxially with the axis of rotation of the yoke assembly 36. The first gear 64 operatively engages a second gear 68 that is fixed to the first end of a second shaft 70, the second shaft 70 being rotatably mounted to the arm 38 of the yoke assembly 36. As such, the second gear 68 and second shaft 70 rotate both with the arm 38 about the axis of rotation and relative to the arm about the axis of the second shaft 70. In the illustrated embodiment, the first gear 64 and the second gear 68 are operatively engaged or interconnected by a belt 72. Thus, as the yoke 36 is rotated about its axis of rotation by the drive motor 54, the second gear 68/second shaft 70 are also rotated relative to the yoke 36.

Figure 6:
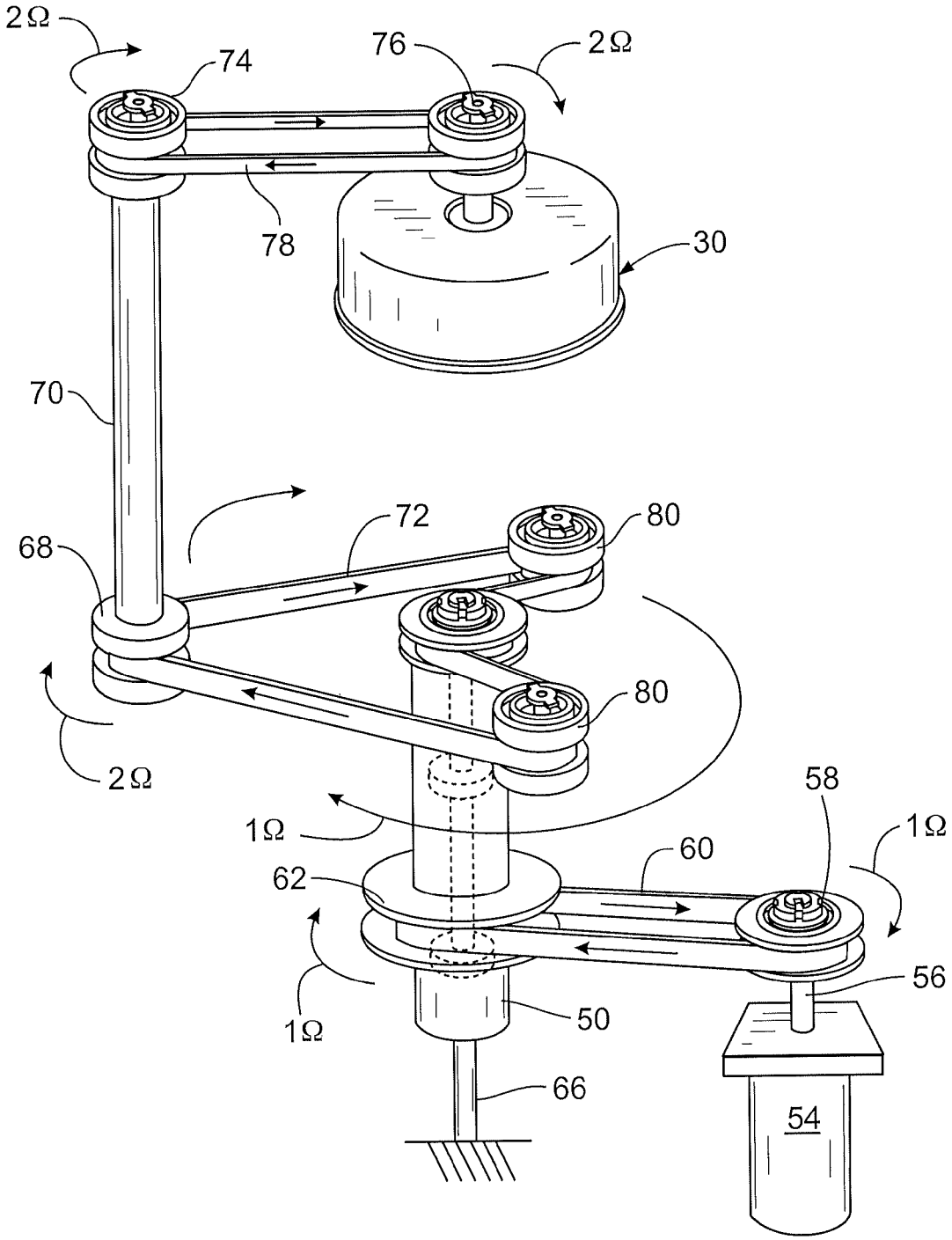
FIG. 6 is an enlarged perspective schematic view showing the operation of the drive system.

A third gear 74 is provided that is fixed to the end of the second shaft 70 opposite to the second gear 68 so that the third gear 74 rotates synchronously with, and at the same rate of rotation as, the second shaft 70 and second gear 68, while also rotating about the axis of rotation of the yoke assembly 36. A fourth gear 76 is provided that is fixed to the chamber assembly 30 so as to rotate simultaneously therewith about the common axis of rotation, with the fourth gear 76 operatively engaging, either directly or indirectly, the third gear 74. As illustrated, the third gear 74 and fourth gear 76 are operatively engaged or interconnected by a belt 78. Thus, as best seen in FIG. 6, upon rotation of the yoke assembly 36 about the first gear 64, the second gear 68 and third gear 74 and interconnecting second shaft 70 are rotated and, in turn, rotate the fourth gear 76.

The ratios of the gears 64, 68, 74 and 76 are such that for each rotation of the yoke 36 about the first gear 64, a single revolution is imparted to the fourth gear 76 (and thus to the chamber assembly 30). More specifically, the ratio of the first gear 64 to the second gear 68 is 1:1, and the ratio of the third gear 74 to the fourth gear 76 is also 1:1. However, the ratio of the first gear 64 to the third gear 74 is not required to equal 1:1. Thus, for each rotation of the yoke 36 at one omega, the second gear/second shaft/third gear and the fourth gear will also rotate an additional revolution, thus providing for two revolutions of the chamber assembly 30 for each revolution of the yoke assembly 36.

In order to ensure the proper direction of rotation of the second gear/second shaft/third gear, the yoke assembly 36 is provided with idler gears 80 that are used to reverse the direction of the belt 72 relative to the first gear 64 so that the chamber assembly 30 is rotated in the same direction as the yoke assembly 30. Alternatively, the idler gears 80 could be associated with the second belt 78 that interconnects the third gear 74 and fourth gear 76 to obtain the same effect.

Thus, an improved drive system for a centrifuge has been disclosed. The description provided above is intended for illustrative purposes only, and is not intended to limit the scope of the disclosure to any particular embodiment described herein. As would be obvious to those skilled in the art, changes and modifications may be made without departing from the disclosure in its broader aspects. Thus, the scope is to be as set forth in the following claims.

The invention claimed is:

1. A drive for rotating a first structure at a first angular velocity relative to a stationary support and rotating a second structure at a second angular velocity relative to the stationary support about a common axis of rotation, the drive comprising:

a rotatable drive shaft supporting the first structure;

a drive motor operatively engaging, directly or indirectly, the drive shaft for rotating the first structure;

the second structure mounted to the first structure so as to be rotatable relative to the first structure about the common axis of rotation;

a first stationary shaft mounted interior of the drive shaft;

a first gear mounted to the first stationary shaft so as to be coaxial with the common axis of rotation and rotatably fixed relative to the stationary support;

a second gear rotatably mounted to the first structure so as to rotate with the first structure about the common axis and axially rotate relative to the first structure, the second gear operatively engaging, directly or indirectly, the first gear to rotate the second gear relative to the first structure upon rotation of the first structure by the drive motor;

a third gear rotatably mounted to the first structure so as to rotate with the first structure about the common axis and axially rotate relative to the first structure synchronously with and at the same rate of rotation as the second gear; and a fourth gear fixed to the second structure for rotation therewith about the common axis, the fourth gear operatively engaging, directly or indirectly, the third gear to rotate the second structure relative to the first structure upon rotation of the first structure by the drive motor.

2. The drive of claim 1 wherein the second gear and the third gear are mounted to a second shaft.

3. The drive of claim 2 further comprising a first belt operatively engaging the first gear to the second gear and a second belt operatively engaging the third gear to the fourth gear.

4. The drive of claim 3 further comprising first and second idler pullies rotatably mounted to the first structure for engagement with one of the first and second belts for reversing the direction of the belt so engaged relative to the first gear or third gear so that the second structure rotates in the same direction about the axis of rotation as the first structure upon rotation of the first structure.

5. The drive of claim 1 in which the ratio of the first gear to the second gear and the ratio of the third gear to the fourth gear is such that for each revolution of the first structure about the axis of rotation the second structure rotates two revolutions.

6. The drive of claim 1 wherein the first structure comprises a yoke assembly and the second structure comprises a centrifuge separation chamber.

7. A centrifuge system having a drive system in accordance with claim 1 in which the second shaft is flexible and the first structure comprises a pivotable arm to which the second structure is mounted, the arm being movable between an open position and a closed, operating position.

8. A centrifuge system having a drive system in accordance with claim 7 in which the first structure is rigid.

* * * * *